US005826662A

United States Patent [19]

Beck et al.

[11] Patent Number: 5,826,662

[45] Date of Patent: Oct. 27, 1998

[54] APPARATUS FOR TESTING AND SAMPLING OPEN-HOLE OIL AND GAS WELLS

[75] Inventors: Harold K. Beck, Copper Canyon; Paul D. Ringgenberg, Carrollton, both of Tex.; Roger L. Schultz, Stillwater, Okla.; Rodney R. Setliff, Corinth, Tex.

[73] Assignee: Halliburton Energy Services, Inc., Dallas, Tex.

[21] Appl. No.: 792,744

[22] Filed: Feb. 3, 1997

[51] Int. Cl.[6] ..... E21B 33/12

[52] U.S. Cl. ..... 166/387; 166/187; 166/191; 166/250.17

[58] Field of Search ..... 166/387, 187, 166/185, 191, 250.07, 250.17

[56] References Cited

U.S. PATENT DOCUMENTS

| | | | |
|---|---|---|---|
| 2,222,829 | 11/1940 | Humason et al. | 166/1 |
| 2,819,038 | 1/1958 | Eckel | 255/1.4 |
| 2,978,046 | 4/1961 | True | 175/233 |
| 3,103,811 | 9/1963 | Ayres et al. | 73/152 |
| 3,107,729 | 10/1963 | Barry et al. | 166/66 |
| 3,111,169 | 11/1963 | Hyde | 166/145 |
| 3,327,781 | 6/1967 | Nutter | 166/3 |
| 3,441,095 | 4/1969 | Youmans | 175/59 |
| 3,448,611 | 6/1969 | Lebourg | 73/151 |
| 3,577,783 | 5/1971 | Whitten et al. | 73/152 |
| 3,611,799 | 10/1971 | Davis | 73/155 |
| 3,780,575 | 12/1973 | Urbanosky | 73/152 |
| 3,799,260 | 3/1974 | Barrington | 166/185 |
| 3,850,240 | 11/1974 | Conover | 166/162 |
| 3,864,970 | 2/1975 | Bell | 73/155 |
| 3,876,003 | 4/1975 | Kisling, III | 166/250 |
| 3,889,750 | 6/1975 | Mullins | 166/217 |
| 4,043,407 | 8/1977 | Wilkins | 175/50 |
| 4,142,594 | 3/1979 | Thompson et al. | 175/59 |
| 4,230,180 | 10/1980 | Patton et al. | 166/185 |
| 4,287,946 | 9/1981 | Brieger | 166/100 |
| 4,339,948 | 7/1982 | Hallmark | 73/155 |
| 4,370,886 | 2/1983 | Smith, Jr. et al. | 73/153 |
| 4,392,376 | 7/1983 | Lagus et al. | 73/155 |
| 4,535,843 | 8/1985 | Jageler | 166/250 |
| 4,573,532 | 3/1986 | Blake | 166/264 |
| 4,583,595 | 4/1986 | Czernichow et al. | 166/264 |
| 4,635,717 | 1/1987 | Jageler | 166/250 |
| 4,745,802 | 5/1988 | Purfurst | 73/155 |
| 4,787,447 | 11/1988 | Christensen | 166/169 |
| 4,856,585 | 8/1989 | White et al. | 166/250 |
| 4,860,580 | 8/1989 | DeRocher | 73/155 |
| 4,903,765 | 2/1990 | Zunkel | 166/162 |
| 4,936,139 | 6/1990 | Zimmerman et al. | 73/155 |
| 5,058,674 | 10/1991 | Schultz et al. | 166/264 |
| 5,105,881 | 4/1992 | Thoms et al. | 166/250 |
| 5,240,072 | 8/1993 | Schultz et al. | 166/169 |
| 5,267,617 | 12/1993 | Perricone et al. | 166/387 |
| 5,287,741 | 2/1994 | Schultz et al. | 73/155 |
| 5,353,875 | 10/1994 | Schultz et al. | 166/297 |
| 5,368,100 | 11/1994 | Lewandowski et al. | 166/264 |
| 5,540,280 | 7/1996 | Schultz et al. | 166/264 |

*Primary Examiner*—Roger J. Schoeppel
*Attorney, Agent, or Firm*—Paul I. Herman; Neal R. Kennedy

[57] ABSTRACT

Method and apparatus for testing and sampling open-hole oil and gas wells. The apparatus includes a packer, a surge chamber, a closure valve which may be opened to flow fluid into the surge chamber, and a sampler. The surge chamber may be one of a pair of surge chambers, and the closure valve may be one of a pair of closure valves so that two surges may be carried out prior to obtaining a fluid sample in the sampler. In operation, the packer is placed in a set position by setting down weight. The closure valves are also actuated when weight is set down. The first closure valve has a first predetermined time delay before opening so that the packer may be set, and the second closure valve has a second predetermined time delay so that the packer may be set and the first closure valve opened before a fluid sample is captured. By opening a vent tool at an upper end of the uppermost surge chamber, formation fluid may be forced back into the formation or zone of interest by a bull-heading operation. In a preferred embodiment, portions of the apparatus are detachable in the event of sticking of the apparatus in the well. In the method of the two-surge test, a clean fluid sample for capturing in the sampler is provided. All of the steps are carried out without flowing fluid to the surface.

42 Claims, 1 Drawing Sheet

APPARATUS FOR TESTING AND SAMPLING OPEN-HOLE OIL AND GAS WELLS

BACKGROUND OF THE INVENTION

1. Field Of The Invention

This invention relates to testing of oil and gas wells, and more particularly, to a method and apparatus for surge testing in an open-hole well.

2. Description Of The Prior Art

During the testing and completion of oil and gas wells, it is often desirable to test the pressure response of a zone of interest in a well by flowing the well for some period of time or flowing a specific volume from the well, and then shutting the well in to obtain a pressure buildup. Samples of produced bottom-hole fluid are often taken as well.

One commonly used well testing procedure is to first cement a casing into the borehole and then perform the testing adjacent zones of interest. Subsequently, the well is flow tested through perforations in the casing. Such flow tests are commonly performed with a drill stem test string which is a string of tubing located within the casing. The drill stem test string carries packers, tester valves, circulating valves and the like to control the flow of fluids through the drill stem test string.

Although drill stem testing of cased wells provides very good test data, it has the disadvantage that the well must first be cased before the tests can be conducted. Also, better reservoir data can be obtained immediately after the well is drilled prior to casing the well and before the formation has been severely damaged by drilling fluids and the like.

For these reasons alone, it is often desirable to evaluate the potential production capability of a well without incurring the costs and delay of casing the well. This has led to a number of attempts at developing a successful open-hole test which can be conducted in an uncased borehole.

One approach which has been used for open-hole testing is the use of a weight set, open-hole compression packer on a drill stem test string. To operate a weight set, open-hole compression packer, a solid surface must be provided on which the weight can be set. Historically, this is accomplished with a perforated anchor which sets down on the bottom.

Another prior art procedure for open-hole testing is shown in U.S. Pat. No. 4,246,964 to Brandell, assigned to the assignee of the present invention. The Brandell patent is representative of the system marketed by the assignee of the present invention as the Halliburton HYDROFLATE system. The HYDROFLATE system includes a pair of spaced inflatable packers which are inflated by a downhole pump. With either of these devices, both of which have advantages and disadvantages, well fluids can then flow up the pipe string which supports the packers in the well.

Another approach to open-hole testing is through the use of pad-type wireline testers which simply press a small resilient pad against the side wall of the borehole and pick up very small unidirectional samples through an orifice in the pad. An example of such a pad-type tester is shown in U.S. Pat. No. 3,577,781 to LeBourg. The primary disadvantage of pad-type testers is that they often take a very small unidirectional sample which is often not truly representative of the formation because it is "dirty" fluid which provides very little data on the production characteristics of the formation. It is also sometimes difficult to seal the pad. When the pad does seal, it is subject to differential sticking, and sometimes a tool may be damaged when it is removed.

Another shortcoming of wireline formation testers which use a pad is that the pad is relatively small. If the permeability of the formation is high, hydrostatic pressure can be transmitted through the formation between the outside of the pad and the center of the pad where the pressure measurement is being made, in a very short period of time. This will result in major hydrostatic pressure soon after attempting to measure formation pressure. This may limit the effectiveness of wireline formation testers in some conditions.

The method and apparatus of the present invention solve these problems by providing for flowing formation fluid into a surge chamber which is placed in communication with the formation or zone of interest by a valve having a built-in time delay so that the valve is not opened until after the packer is set. The fluid is then flowed into a surge chamber which prevents the capturing of "dirty" fluid which initially comes out of the formation or zone of interest, while allowing capturing of a sample of the cleaner, more representative fluid flowing behind the dirty fluid. In a preferred embodiment, two such fluid surges are utilized to insure clean fluid.

Another approach which has been proposed in various forms, but which to the best of our knowledge has never been successfully commercialized, is to provide an outer tubing string with a packer which can be set in a borehole, and in combination with a wireline run surge chamber which is run into engagement with the outer string so as to take a sample from below the packer. One example of such a system is shown in U.S. Pat. No. 3,111,169 to Hyde, and assigned to the assignee of the present invention. Other examples of such devices are seen in U.S. Pat. No. 2,497,185 to Reistle, Jr.; U.S. Pat. No. 3,107,729 to Barry, et al.; U. S. Pat. No. 3,327,781 to Nutter; U.S. Pat. No. 3,850,240 to Conover; and U.S. Pat. No. 3,441,095 to Youmans. A disadvantage, obviously, is the extra time necessary to run in and position the surge chamber.

A number of improvements in open-hole testing systems of the type generally proposed in U.S. Pat. No. 3,111,169 to Hyde are shown in U.S. Pat. No. 5,540,280, assigned to the assignee of the present invention. In a first aspect of the invention of U.S. Pat. No. 5,540,280, a system is provided including an outer tubing string having an inflatable packer, and a communication passage disposed through the tubing string below the packer, an inflation passage communicated with the inflatable element of the packer, and an inflation valve controlling flow of inflation fluid through the inflation passage. The inflation valve is constructed so that the opening and closing of the inflation valve is controlled by a surface manipulation of the outer tubing string. Thus, the inflatable packer can be set in the well simply by manipulation of the outer tubing string and applying fluid pressure to the tubing string without running an inner well tool into the tubing string. After the packer has been set, an inner well tool, such as a surge chamber, may be run into and engaged with the outer tubing string to place the inner well tool in communication with a subsurface formation through the communication passage. There is also an embodiment with a straddle packer having upper and lower packer elements which are engaged on opposite sides of the formation.

In another aspect of this prior invention, the well fluid samples are collected by running an inner tubing string, preferably an inner coiled tubing string, into the previously described outer tubing. The coiled tubing string is engaged with the outer tubing string, and the bore of the coiled tubing string is communicated with a subsurface formation through the circulation passage defined in the outer tubing string. Then, well fluid from the subsurface is flowed through the communication passage and up the coiled tubing string. Such a coiled tubing string may include various valves for control of fluid flow therethrough. This prior invention does not include the use of a surge chamber or sampler downhole to obtain the fluid sample.

Conventional open-hole testing of oil wells is often dangerous due to differential pipe-sticking problems, and "live" well conditions at the surface. That is, any time fluid is flowed to the surface, there is a possibility of problems.

The present invention solves this problem by providing a method and apparatus for performing a test and obtaining a sample with hydrostatic pressure at the formation or zone of interest. That is, in the present invention, the testing of sampling is done under "dead well" conditions. In a preferred embodiment, a limited flow, two-surge test is carried out in an open-hole well without any of the usual safety problems encountered in conventional open-hole testing. Thus, quick, safer testing of open-hole formations can be performed even in extremely harsh environment conditions.

Most testing tools require custom-made equipment. A major advantage of the present invention is that it uses components which are already known and generally available. However, the arrangement of the components to form the apparatus of the present invention is new, as is the method of testing of an open-hole well. In other words, known components are used in the present invention to form a novel apparatus and are used in a novel way.

SUMMARY OF THE INVENTION

The purpose of the method and apparatus of the present invention is to test the pressure response of a zone of interest in a well by flowing fluid from the well for a specific period of time. A specific volume is flowed and samples of produced fluid are taken in the open-hole well.

The present invention includes a method of servicing an open-hole well. The method comprises the step of running a well tool into the well. The tool comprises a surge chamber, a closure valve in communication with the surge chamber wherein the closure valve has a normally closed position and comprises an opener or actuator for opening after a predetermined time delay, and a packer having a compressible packer element engagable with an inner surface of the well adjacent to a formation or zone of interest in the well. In one embodiment, the tool may further comprise a sampler in communication with the surge chamber. The method further comprises setting down weight such that the packer element is sealingly engaged with the inner surface of the well. The opener is actuated to open the closure valve after setting of the packer. The method further comprises the steps of flowing fluid from the zone into the surge chamber.

The method may also comprise capturing a pressure signal of fluid in the sampler. The step of capturing a pressure signal of fluid preferably comprises pressure actuating the sampler to open after a predetermined time. This predetermined time is preferably of sufficient duration to prevent capturing the pressure signal of fluid prior to setting of the packer and opening of the closure valve.

The apparatus may further comprise, after flowing fluid, opening a vent in the tool, the vent being in communication with the surge chamber, and pumping fluid down the tool and through the vent into a well annulus below the set packer so that formation fluid is forced back into the formation or zone of interest.

The method may further comprise the steps of unsetting the packer and retrieving the tool from the well with the pressure signal in the sampler. After retrieving the tool, the surge chamber may be drained prior to removing the sampler.

In one preferred embodiment, the surge chamber is a first surge chamber disposed below the packer, and the closure valve is a first closure valve in communication with the first surge chamber. The first closure valve is adapted for opening after a first predetermined time delay. The tool run into the well further comprises a second surge chamber disposed above the packer and a second closure valve in communication with the second surge chamber. The second closure valve has a normally closed position and is adapted for opening after a second predetermined time delay. In this embodiment, the sampler is in communication with the second surge chamber.

In the method of this preferred embodiment, the first and second closure valves are activated, and the method further comprises opening the first closure valve after the first predetermined time delay and after setting of the packer, flowing fluid from the formation or zone of interest through the first closure valve into the first surge chamber, opening the second closure valve after the second predetermined time delay and after setting of the packer and opening of the first closure valve, flowing fluid from the formation or zone of interest through the second closure valve into the second surge chamber. The method may additionally comprise capturing a pressure signal in the sampler.

The packer in the tool may be a straddle packer, and the step of setting the packer comprises setting a pair of packer elements on the packer in sealing engagement with the inner surface of the well on opposite sides of the formation or zone of interest. The setting of the packer elements is substantially simultaneous.

The method may further comprise the steps of unsetting the packer, and retrieving the tool from the well with the pressure signal in the sampler, after which the surge chamber may be drained prior to removing the sampler.

The present invention also includes an apparatus for use in an open-hole well. The apparatus comprises a packer having a packer element adapted for engagement with an inner surface of the well adjacent to a formation or zone of interest in the well when the packer is in a set position, a surge chamber connected to the packer, a closure valve in communication with the surge chamber, the closure valve having a normally closed position and being adapted for opening after a predetermined time delay. The apparatus may also comprise a sampler. The packer is preferably a weight-actuated compression packer. The predetermined time delay is sufficient to allow setting of the packer before the closure valve is opened. The sampler is pressure actuated and adapted for opening after a predetermined time such that the sampler is opened after the setting of the packer and the opening of the closure valve.

The apparatus may also comprise a vent tool having a normally closed position and an open position wherein fluid may be pumped downwardly through the apparatus to force formation fluid back into the formation or zone of interest after flowing fluid into the surge chamber.

The packer may be a straddle packer having upper and lower packer elements such that the upper packer element is sealingly engagable with the inner surface of the well adjacent to an upper side of the formation or zone of interest and the lower packer element is sealingly engagable with the inner surface adjacent to a lower side of the formation or zone of interest.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1:
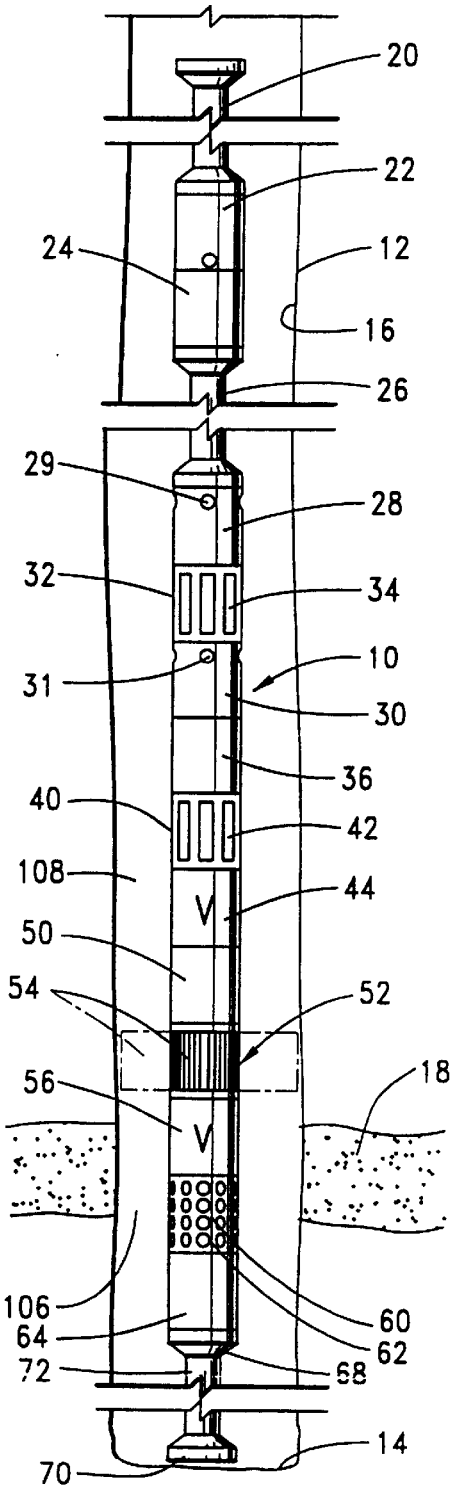
FIG. 1 illustrates the apparatus for testing and sampling open-hole oil and gas wells of the present invention in a single packer embodiment.

Referring now to the drawings, and more particularly to FIG. 1, a first embodiment of the apparatus for testing and sampling open-hole oil and gas wells of the present invention is shown and generally designated by the numeral 10. Apparatus 10 is illustrated as it is run into a well 12. Apparatus 10 is designed to engage a bottom 14 of an uncased borehole 16 of well 12. In the illustrated embodiment, borehole 16 intersects a subsurface formation or zone of interest 18. As used herein, reference to a "zone of interest" includes a subsurface formation.

Apparatus 10 is at the lower end of a tool string 20 which may also be referred to as a length of drill pipe 20.

At the upper end of first embodiment 10 is a circulating valve 22 which is preferably weight-operated. Below circulating valve 22 is a tubing pressure operated vent tool 24.

The lower end of vent tool 24 is connected to an upper surge chamber 26 which comprises a length of elongated pipe.

Below surge chamber 26 are an upper drain valve 28 and a lower drain valve 30 separated by a mini-sampler carrier 32. Upper drain valve 28 has a drain plug 29 therein, and lower drain valve 30 has a drain plug 31 therein. Drain plugs 29 and 31 may be removed when apparatus 10 is retrieved to the surface so that fluid may be drained therefrom as further described herein.

A plurality of independently activated samplers 34 are disposed in mini-sampler carrier 32. Samplers 34 may be similar to the Halliburton mini-samplers. Halliburton mini-samplers are pressure activated and adapted to trap a pressure signal therein after a predetermined time.

Below lower drain valve 30 is an upper closure valve 36 which may be weight-operated, such as a Halliburton Hydrospring testing valve. Upper closure valve 30 comprises a metering section therein which keeps the valve in a closed position initially and will allow opening thereof after a predetermined time delay.

Below upper closure valve 36 is a gauge carrier 40. Gauge carrier 40 is adapted to carry a plurality of gauges 42 which can include any desired electrical or mechanical pressure and/or temperature recording instrument. Thus, gauges 42 may also be referred to as recorders 42. An electronic memory recording fluid resistivity tool, such as manufactured by Sondex or Madden, may also be placed in gauge carrier 40.

Below gauge carrier 40, apparatus 10 further comprises a VR safety joint 44 below which is a jar 50. The VR safety joint is adapted for shearably disconnecting when sufficient load is applied thereto. This may be necessary if a portion of formation 18 or well 12 collapses around the tool. Jar 50 allows pulling on tool string 20 to try to jar apparatus 10 loose. VR safety joint 44 and jar 50 are conventional devices and are used in their conventional manner.

The lower end of jar 50 is connected to an open-hole packer 52. Packer 52 is a preferably compression-set packer having a compressible elastomeric packer element 54 which is squeezed outwardly to sealingly engage borehole 16 when weight is set down on tool string 20. Other types of packers could be used. As will be further seen herein, apparatus 10 is constructed such that packer 52 is disposed above zone of interest 18.

An anchor pipe safety joint 56 is connected to the lower end of packer 52. A perforated anchor 60 is disposed below anchor pipe safety joint 56 and is generally at the same depth in well 12 as zone of interest 18. That is, perforated anchor 60 is generally aligned with at least a portion of zone 18. Perforated anchor 60 has a plurality of openings 62 defined therein.

A lower closure valve 64, which may be weight-operated, is disposed below perforated anchor 60. Lower closure valve 64 is similar to upper closure valve 36 and may include an upside-down Halliburton Hydrospring tester valve. Lower closure valve 64 also has a metering section which keeps the lower closure valve in a closed position and will allow opening thereof after a predetermined time delay. As will be further described herein, the time delay for opening lower closure valve 38 is a first time delay sufficient to allow setting of packer 62. The metering in upper closure valve 36 is relatively longer than that in lower closure valve 64 so that upper closure valve 36 will not be opened until after setting of packer 52 and the opening of lower closure valve 64. Thus, the time delay of upper closure valve 36 may be referred to as a second time delay.

At the lowermost end of apparatus 10 is an anchor pipe section 68 having a lower end 70 adapted for engagement with bottom 14 of well 12. Anchor pipe section 68 includes a length of tubing or pipe which is hollow and of sufficient length 70 form a lower surge chamber 72 in apparatus 10.

Figure 2:
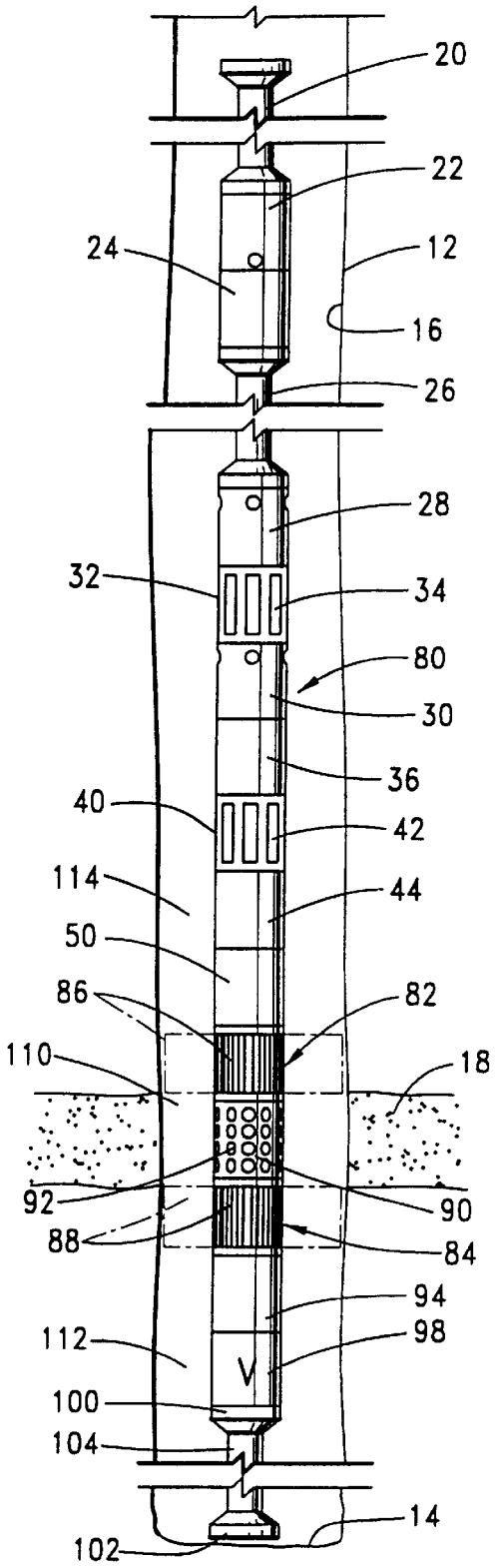
FIG. 2 shows an alternate embodiment of the apparatus having a straddle packer.

Referring now to FIG. 2, a second embodiment of the apparatus for testing and sampling open-hole oil and gas wells is shown and generally designated by the numeral 80. Like first embodiment 10, second embodiment 12 is shown as it is run into a well 12. Second embodiment 12 is also designed for use at a bottom 14 of an uncased borehole 16. Borehole 16 intersects a subsurface formation or zone of interest 18.

An upper portion of apparatus 80 is substantially identical to that of first embodiment apparatus 10, and the same reference numerals will be used for those components. Therefore, second embodiment apparatus 80 is connected to a tool string or drill pipe 20. Apparatus 80 comprises, starting at the top of FIG. 2, circulating valve 22 which is preferably weight-operated, tubing pressure operated vent tool 24, upper surge chamber 26, upper drain valve 28, mini-sampler carrier 32 with mini-samplers 34 disposed therein, lower drain valve 30, upper closure valve 36, gauge carrier 40 with gauges or recorders 42 therein, VR safety joint 44 and jar 50.

Second embodiment 80 has a straddle packer configuration rather than the single packer configuration of FIG. 1. Thus, second embodiment 80 comprises an upper packer 82 and a lower packer 84 spaced downwardly from the upper packer. Upper packer 82 is connected to the lower end of jar 50. Upper and lower packers 82 and 84 are substantially identical, and in fact, are substantially identical to packer 52 and first embodiment 10. Therefore, upper packer 82 has a packer element 86 adapted for sealingly engaging borehole 16 above zone 18 when second embodiment apparatus 80 is placed in operation, and lower packer 84 has a packer element 88 adapted for sealing engagement with borehole 16 below zone 18.

A perforated anchor 90 is disposed between upper and lower packers 82 and 84. Perforated anchor 90 is substantially identical to perforated anchor 60 in first embodiment 10 and comprises a plurality of fluid flow openings. 92 therein.

Below lower packer 84 is a lower closure valve 94 which is substantially identical to lower closure valve 64 in the first embodiment.

A below packer safety joint 98 is connected to the lower end of lower closure valve 94. Below packer safety joint 98 is similar to VR safety joint 44 in that it allows disconnecting of the portion of apparatus 80 thereabove from the portion therebelow, as may be necessary when the lower portion becomes stuck in well 12.

At the lower end of second embodiment apparatus 80 is an anchor pipe section connected to the lower end of below packer safety joint 98. Anchor pipe section 100 has a lower end 102 adapted for engagement with bottom 14 of well 12. Anchor pipe section 90 also includes an elongated tubing or pipe portion which is hollow and thus forms a lower surge chamber 104.

A metering section in lower closure valve 94 keeps the lower closure valve closed until after a predetermined time delay which is sufficient for the setting of upper and lower packers 82 and 84. The metering section in upper closure valve 36 of second embodiment apparatus 80 has a sufficient time delay before opening of upper closure valve 36 so that enough time is provided to set upper and lower packers 82 and 84 and open lower closure valve 94.

OPERATION OF THE INVENTION

Referring to FIG. 1, first embodiment apparatus 10 is shown as it is lowered into borehole 16 of well 22 until lower end 70 engages bottom 14 of well 12. After this engagement, weight may be set down on tool string 20. As apparatus 10 is lowered into well 12, fluid may be circulated in the well through circulating valve 22.

When weight is applied to apparatus 10, packer element 54 of packer 52 is compressed outwardly until it engages borehole 16 as indicated by the phantom lines in FIG. 1. This seals off a lower portion 106 of the well from an upper portion 108 above packer 52. Thus, lower portion 106 is an annular volume adjacent to and in communication with formation 18. That is, the formation area to be tested is sealingly isolated from the hydrostatic column of fluid in upper portion 108 above packer 52.

The metering section inside lower or first closure valve 64 is actuated, such as when weight is first set down. As previously indicated, the metering section in lower closure valve 64 provides a sufficient first time delay for packer 52 to be set before lower closure valve 64 is opened. When the metering is complete, lower closure valve 64 opens, allowing fluid to be produced from formation 18 into lower or first surge chamber 72. That is, well fluid flows into perforated anchor 60 and down into lower surge chamber 62 through open lower closure valve 64.

The metering section in upper or second closure valve 36 is also actuated, such as upon the setting down of weight previously described. This metering provides a sufficient second time delay for packer 52 to be set and for lower closure valve 64 to be opened. The second time delay also allows sufficient time for fluid to be produced from formation 18 into lower surge chamber 72. After this slower metering, upper closure valve 36 will open, allowing fluid to surge through perforated anchor 60 and up through apparatus 10 into upper or second surge chamber 26. At this point, any sampler 34, which is pressure operated, may be actuated if desired to trap a pressure signal of the fluid which has been produced into upper surge chamber 26.

Gauges 42 in gauge carrier 40 are adapted to constantly read the formation pressure during both surges, thereby providing drawdown and buildup data from two different fluid flow periods.

After the pressure signals are taken by samplers 34, tubing pressure may be applied at the surface to open tubing pressure operated vent tool 24. Produced fluid can then be "bull-headed" back into formation or zone 18. After this operation, weight may be taken off tool string 20, and thus off apparatus 10, to unset packer 52 so that apparatus 10 may be removed from well 12.

After apparatus 10 is retrieved to the surface, samplers 34 are removed from sampler carrier 40. Fluid may be drained from apparatus 10 through upper and lower drain valves 28 and 30 by removing drain plugs 29 and 31 therefrom, respectively. Samplers 34 may be drained on location, their contents may be transferred to a sample bottle for shipment to a pressure-volume-test (PVT) laboratory, or the samplers may be shipped to a PVT laboratory for fluid transfer and testing.

The operation of second embodiment apparatus 80 is very similar, except that when weight is set down on tool string 20 and apparatus 80, both upper and lower packers 82 and 84 are compressed out into engagement with borehole 16 on opposite sides of zone 18 as shown in phantom lines in FIG. 2. Thus, an annular volume 110 is defined between upper and lower packers 82 and 84 when the packers are in the set position, and this annular volume 110 is adjacent to and in communication with formation or zone 18. Lower packer 834 sealingly separates annular volume 110 from lower portion 112 of well 12, and similarly, upper packer 82 sealingly separates annular volume 110 from upper portion 114 of well 12. Thus, the straddle packer configuration of second embodiment apparatus 80 reduces the area from which formation fluid will flow from formation or zone 18. This allows better cleanup and reduces mud contamination to the pressure signals which are taken. The remaining steps in the operation of second embodiment to apparatus 80 are substantially identical to those for first embodiment 10, with the steps previously described for lower or first closure valve 64 in the first embodiment being applicable to lower or first closure valve 94 in the second embodiment.

It will be seen, therefore, that the apparatus for testing and sampling open-hole oil and gas wells is well adapted to carry out the ends and advantages mentioned as well as those inherent therein. While presently preferred embodiments of the apparatus have been shown for the purposes of this disclosure, numerous changes in the arrangement and construction of parts may be made by those skilled in the art.

What is claimed is:

1. A method of servicing an open-hole well, comprising the steps of:

(a) running a well tool into the well, said tool comprising:

a surge chamber;

a closure valve in communication with said surge chamber, said closure valve having a normally closed position and comprising an opener which when actuated initiates a predetermined time delay and automatically opens said closure valve after said predetermined time delay; and a packer having a packer element engagable with an inner surface of said well adjacent to a zone of interest in said well;

(b) activating said tool such that:

said packer element is sealingly engaged with said inner surface of said well; and said opener is actuated substantially simultaneously with the setting of said packer; and (c) after said closure valve is opened by said opener, flowing fluid from said zone through the open closure valve into said surge chamber.

2. The method of claim 1 wherein said tool further comprises a sampler in communication with said surge chamber and further comprising:

(d) capturing a pressure signal in said sampler.

3. The method of claim 2 wherein step (d) comprises pressure actuating said sampler to open after a predetermined time.

4. The method of claim 3 wherein said predetermined time is of sufficient duration to prevent capturing said pressure signal prior to setting said packer and opening said closure valve.

5. The method of claim 2 further comprising:

(e) unsetting said packer; and (f) retrieving the tool from the well with said pressure signal in said sampler.

6. The method of claim 5 further comprising:

after step (f) draining said surge chamber.

7. The method of claim 2 further comprising:

(e) disconnecting said surge chamber, closure valve and sampler from said packer; and (f) retrieving said surge chamber, closure valve and sampler from the well with said sample of fluid in said sampler.

8. The method of claim 1 further comprising:

(d) after step (c), opening a vent in said tool, said vent being in communication with said surge chamber; and (e) pumping fluid down said tool and through said vent into a well annulus below the set packer so that formation fluid is forced back into the zone.

9. The method of claim 1 further comprising:

(d) unsetting said packer; and (e) retrieving the tool from the well.

10. The method of claim 9 further comprising:

after step (e), draining said surge chamber.

11. The method of claim 1 wherein:

said packer in said tool is a straddle packer; and step (b) comprises setting a pair of packer elements on said packer in sealing engagement with said inner surface of said well on opposite sides of said zone of interest.

12. The method of claim 11 wherein said pair of packer elements is set substantially simultaneously.

13. The method of claim 1 further comprising measuring properties of said flowing fluid on a recording instrument.

14. The method of claim 1 wherein:

said packer and said opener are weight actuated; and step (b) is carried out by setting down weight on the well tool in the well.

15. A method of servicing an open-hole well, comprising the steps of:

(a) running a well tool into the well, said tool comprising:

a packer having a packer element engagable with an inner surface of said well adjacent to a zone of interest in said well;

a first surge chamber operatively connected to said packer;

a second surge chamber operatively connected to said packer;

a first closure valve in communication with said first surge chamber, said first closure valve having a normally closed position and adapted for automatically opening after a first predetermined time delay; and a second closure valve in communication with said second surge chamber, said second closure valve having a normally closed position and adapted for automatically opening after a second predetermined time delay;

(b) activating said tool such that:

said packer element is set into sealing engagement with said inner surface of said well; and said first and second closure valves are activated thereby initiating said first and second predetermined time delays substantially simultaneously with the setting of said packer element into sealing engagement with said inner surface of said well;

(c) automatically opening said first closure valve after said first predetermined time delay and after setting of said packer;

(d) flowing fluid from said zone through said first closure valve into said first surge chamber;

(e) automatically opening said second closure valve after said second predetermined time delay and after setting of said packer and opening of said first closure valve; and (f) flowing fluid from said zone through said second closure valve into said second surge chamber.

16. The method of claim 15 wherein said tool further comprises a sampler in communication with said second surge chamber, and further comprising:

(g) capturing a pressure signal in said sampler.

17. The method of claim 16 wherein step (g) comprises pressure-actuating said sampler to open after a predetermined time.

18. The method of claim 17 wherein said predetermined time to open said sampler is sufficient to prevent capturing said pressure signal prior to setting said packer and opening said first and second closure valves.

19. The method of claim 16 further comprising:

(h) unsetting said packer; and (i) retrieving the tool from the well with said pressure signal in said sampler.

20. The method of claim 19 further comprising:

(j) after step (i), draining said surge chamber.

21. The method of claim 16 further comprising:

(h) disconnecting said surge chamber, closure valve and sampler from said packer; and (i) retrieving said surge chamber, closure valve and sampler from the well with said sample of fluid in said sampler.

22. The method of claim 15 further comprising:

(g) unsetting said packer; and (h) retrieving the tool from the well.

23. The method of claim 22 further comprising:

(i) after step (h), draining said surge chamber.

24. The method of claim 15 further comprising:

(g) disconnecting said surge chamber and closure valve from said packer; and (h) retrieving said surge chamber and closure valve from the well.

25. The method of claim 15 wherein:

said packer in said tool is a straddle packer having upper and lower packer elements;

said first surge chamber is below said lower packer element;

said second surge chamber is above said upper packer element; and step (b) comprises setting said upper and lower packer elements in sealing engagement with said inner surface of said well on opposite sides of said zone of interest.

26. The method of claim 15 further comprising:

(h) after step (g), opening a vent in said tool, said vent being in communication with said second surge chamber; and (i) pumping fluid down said tool and into a well annulus below the set packer so that formation fluid is forced back into the formation.

27. The method of claim 15 wherein:

said packer and said first and second closure valves are weight actuated; and said packer element is set into sealing engagement with said inner surface of said well and said first and second closure valves are activated by setting down weight on the well tool in the well.

28. An apparatus for use in an open-hole well, said apparatus comprising:

a packer having a packer element adapted for engagement with an inner surface of the well adjacent to a zone of interest in the well when the packer is in a set position;

a surge chamber connected to said packer; and a closure valve in communication with said surge chamber, said closure valve having a normally closed position and comprising an opener which is adapted for being actuated substantially simultaneously with the setting of said packer and thereby automatically opening said closure valve at a predetermined time delay after the setting of said packer.

29. The apparatus of claim 28 wherein:

said packer is weight actuated;

said closure valve is weight actuated; and said packer and closure valve are actuated when weight is set down on the apparatus in the well.

30. The apparatus of claim 28 further comprising a sampler.

31. The apparatus of claim 30 wherein said sampler is pressure actuated and adapted for opening after a predetermined time such that said sampler is opened after setting of said packer and opening of said closure valve.

32. The apparatus of claim 30 further comprising a vent tool having a normally closed position and an open position wherein fluid may be pumped downwardly through the apparatus to force formation fluid back into the zone of interest after capturing a pressure signal in said sampler.

33. The apparatus of claim 30 wherein said sampler is in communication with said surge chamber.

34. The apparatus of claim 28 where in said packer is a straddle packer having upper and lower packer elements such that said upper packer element is sealingly engagable with said inner surface of said well adjacent to an upper side of said zone and said lower packer element is sealingly engagable with said inner surface adjacent to a lower side of the zone.

35. The apparatus of claim 28 further comprising a vent tool having a normally closed position and an open position wherein fluid may be pumped downwardly through the apparatus to force formation fluid back into the zone of interest.

36. The apparatus of claim 28 wherein:

said surge chamber is a first surge chamber;

said closure valve is a first closure valve and said predetermined time delay is a first predetermined time delay; and further comprising:

a second surge chamber connected to said packer; and a second closure valve in communication with said second surge chamber, said second closure valve having a normally closed position and comprising an opener which is adapted for being actuated substantially simultaneously with the setting of said packer and the actuation of said opener in said first closure valve and thereby automatically opening said second closure valve at a second predetermined time delay which is longer than said first predetermined time delay.

37. The apparatus of claim 36 wherein:

said first surge chamber is disposed below said packer; and said second surge chamber is disposed above said packer.

38. The apparatus of claim 36 further comprising a sampler which is pressure actuated and adapted for opening after a predetermined time such that said sampler is opened after setting of said packer and opening of said first and second closure valves.

39. The apparatus of claim 38 wherein said sampler is in communication with said second surge chamber.

40. The apparatus of claim 36 wherein:

said packer is a straddle packer having upper and lower packer elements such that said upper packer element is sealingly engagable with said inner surface of said well adjacent to an upper side of said zone and said lower packer element is sealingly engagable with said inner surface adjacent to a lower side of said zone;

said first surge chamber is below said lower packer element; and said second surge chamber is above said upper packer element.

41. The apparatus of claim 28 wherein said packer is a drillable packer.

42. The apparatus of claim 36 wherein:

said packer is weight actuated;

said first and second closure valves are weight actuated; and said packer and said first and second closure valves are actuated when weight is set down on the apparatus in the well.

* * * * *